US010349795B2

(12) United States Patent
Kwak

(10) Patent No.: US 10,349,795 B2
(45) Date of Patent: Jul. 16, 2019

(54) AUTONOMOUS MOBILE CLEANER AND CONTROL METHOD THEREOF

(71) Applicant: LG ELECTRONICS INC., Seoul (KR)

(72) Inventor: Donghoon Kwak, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 127 days.

(21) Appl. No.: 15/539,930

(22) PCT Filed: Dec. 8, 2015

(86) PCT No.: PCT/KR2015/013344
§ 371 (c)(1),
(2) Date: Jun. 26, 2017

(87) PCT Pub. No.: WO2016/104992
PCT Pub. Date: Jun. 30, 2016

(65) Prior Publication Data

US 2017/0354304 A1 Dec. 14, 2017

(30) Foreign Application Priority Data

Dec. 26, 2014 (KR) ..... 10-2014-0191054

(51) Int. Cl.
*G06F 19/00* (2018.01)
*A47L 9/28* (2006.01)
(Continued)

(52) U.S. Cl.
CPC ..... *A47L 9/2852* (2013.01); *A47L 5/36* (2013.01); *A47L 5/362* (2013.01); *A47L 9/009* (2013.01);
(Continued)

(58) Field of Classification Search
CPC ..... A47L 2201/04; A47L 5/36; A47L 5/362; A47L 9/009; A47L 9/102; A47L 9/12;
(Continued)

(56) References Cited

U.S. PATENT DOCUMENTS

2005/0021181 A1 1/2005 Kim et al.
2005/0055792 A1* 3/2005 Kisela ..... A47L 5/36 15/319
(Continued)

FOREIGN PATENT DOCUMENTS

EP 2 630 903 8/2013
KR 10-2010-0081251 7/2010
(Continued)

OTHER PUBLICATIONS

Russian Office Action dated May 23, 2018 issued in Application No. 2017126602 (with English translation).
(Continued)

*Primary Examiner* — Harry Y Oh
(74) *Attorney, Agent, or Firm* — KED & Associates, LLP

(57) ABSTRACT

Provided is an autonomous mobile cleaner including a main body, a suction unit having a handle and configured to suck up surrounding foreign material, an air pipe configured to connect the main body and the suction unit and guide the foreign material into the main body, at least one driving wheel installed below the main body, a driving unit configured to drive the driving wheel by operating a driving motor, a wheel sensor configured to sense rotation of the driving wheel, and a controller configured to control the movement of the main body through the driving unit on the basis of the rotation of the driving wheel sensed by the wheel sensor.

17 Claims, 6 Drawing Sheets

(51) Int. Cl.

| | |
|---|---|
| ***A47L 5/36*** | (2006.01) |
| ***A47L 9/00*** | (2006.01) |
| ***A47L 9/10*** | (2006.01) |
| ***A47L 9/12*** | (2006.01) |
| ***A47L 9/14*** | (2006.01) |

(52) U.S. Cl.
CPC ..... *A47L 9/102* (2013.01); *A47L 9/12* (2013.01); *A47L 9/1409* (2013.01); *A47L 9/2805* (2013.01); *A47L 9/2884* (2013.01); *A47L 2201/04* (2013.01)

(58) Field of Classification Search
CPC .... A47L 9/1409; A47L 9/2805; A47L 9/2852; A47L 9/2884
See application file for complete search history.

(56) References Cited

U.S. PATENT DOCUMENTS

| | | | | |
|---|---|---|---|---|
| 2006/0020369 | A1* | 1/2006 | Taylor | A47L 9/009 700/245 |
| 2008/0276408 | A1* | 11/2008 | Gilbert, Jr. | A47L 11/34 15/320 |
| 2009/0133720 | A1* | 5/2009 | Van Den Bogert | A47L 5/362 134/18 |
| 2010/0132149 | A1 | 6/2010 | Jeong et al. | |
| 2011/0295480 | A1* | 12/2011 | Shimada | B60K 17/35 701/70 |
| 2012/0084936 | A1* | 4/2012 | Li | A47L 9/009 15/319 |
| 2013/0025085 | A1* | 1/2013 | Kim | A47L 9/2805 15/319 |
| 2013/0212829 | A1* | 8/2013 | Yoon | A47L 5/36 15/319 |
| 2014/0288709 | A1 | 9/2014 | Sim et al. | |
| 2015/0059119 | A1* | 3/2015 | Yato | A47L 9/19 15/339 |
| 2016/0000287 | A1* | 1/2016 | Tsuboi | A47L 9/2805 15/319 |
| 2016/0202703 | A1* | 7/2016 | Matsubara | G05D 1/0219 701/24 |

FOREIGN PATENT DOCUMENTS

| | | |
|---|---|---|
| WO | 2007/002699 | 1/2007 |
| WO | WO 2007/093926 | 8/2007 |
| WO | WO 2008/117945 | 10/2008 |

OTHER PUBLICATIONS

European Patent Office Communication dated May 3, 2018 issued in Application No. 15873519.1.
International Search Report and Written Opinion in International Application No. PCT/KR2015/013344, dated Mar. 9, 2016, 17 pages.

* cited by examiner

[Fig. 1]
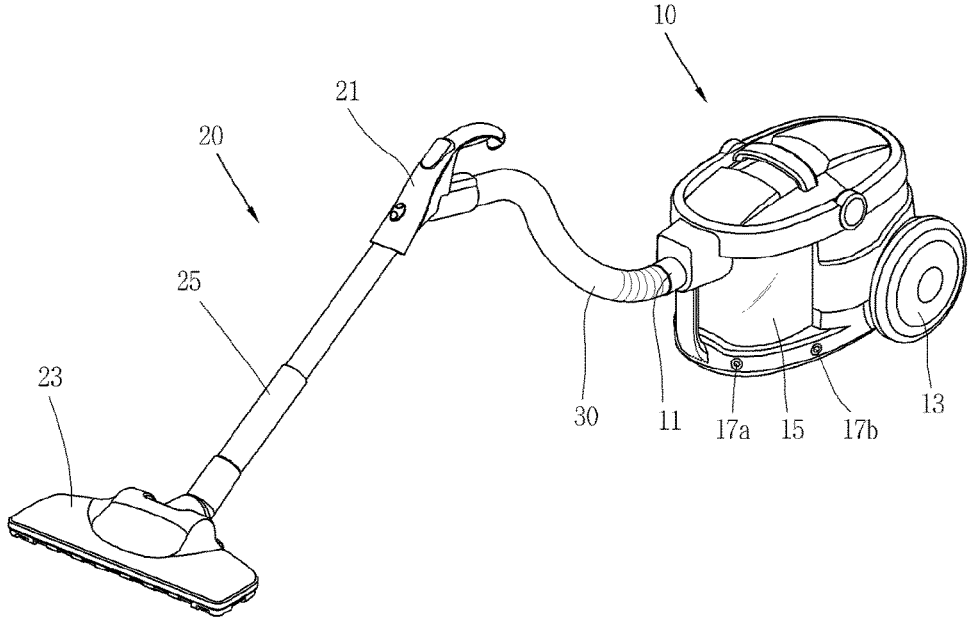
[Fig. 2]
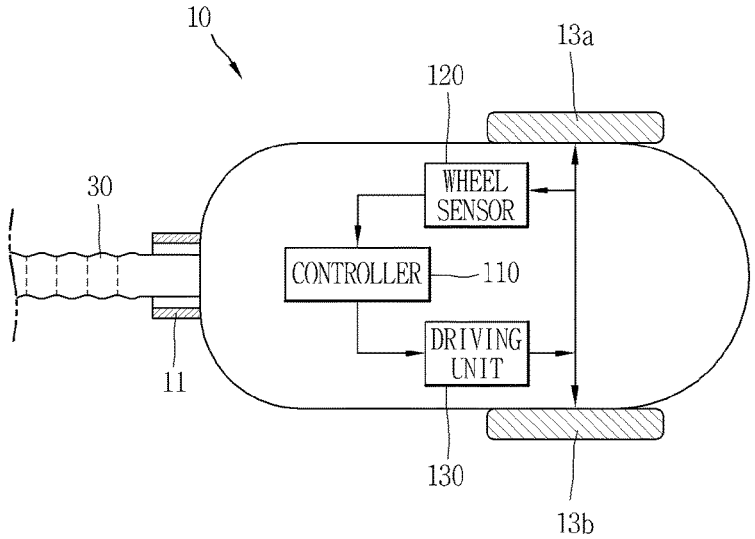

[Fig. 3]
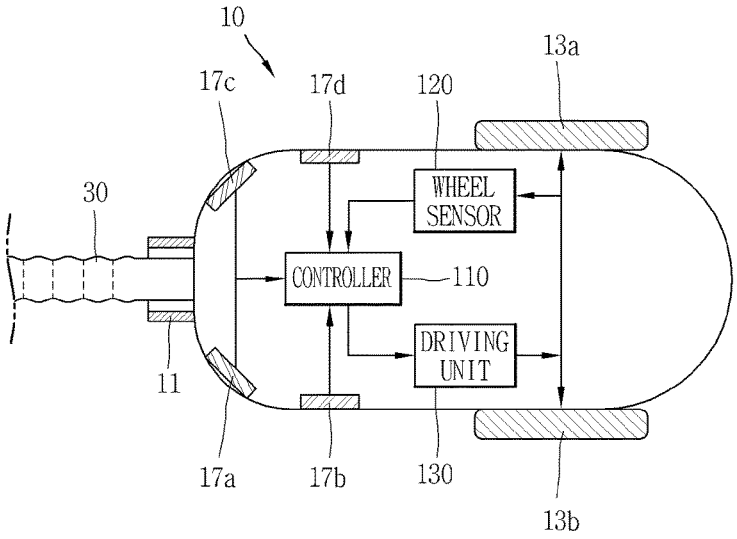
[Fig. 4]
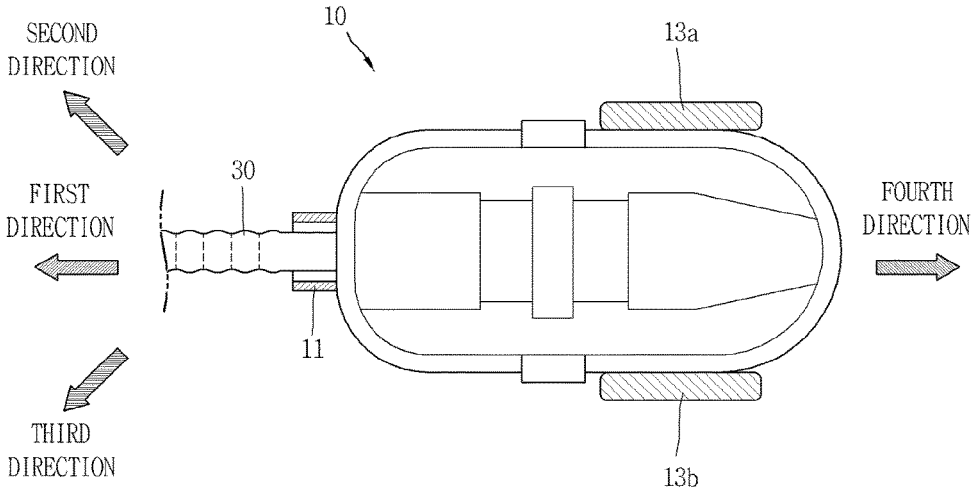

[Fig. 5a]
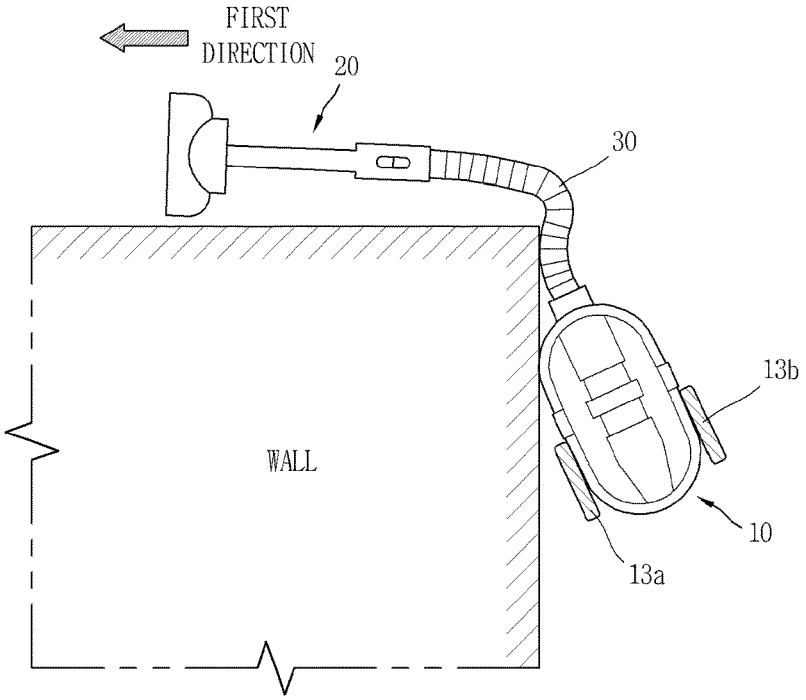
[Fig. 5b]
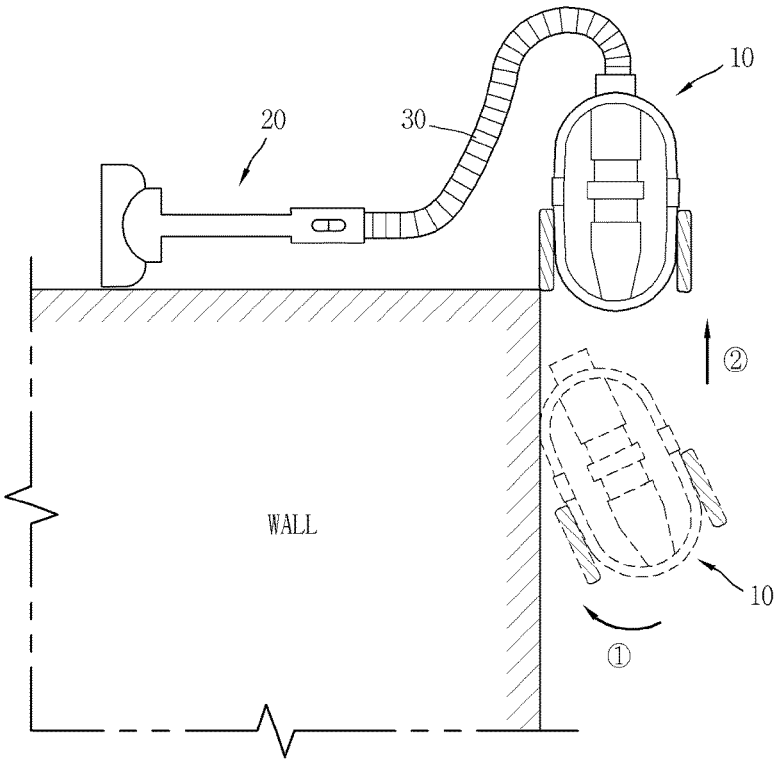

[Fig. 5c]
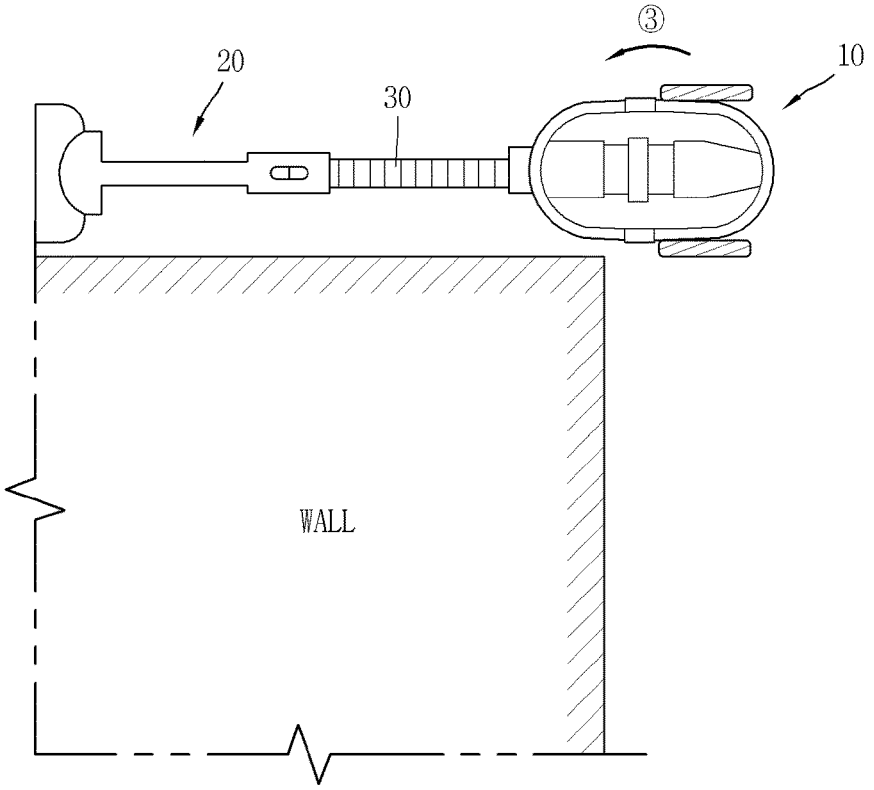
[Fig. 6a]
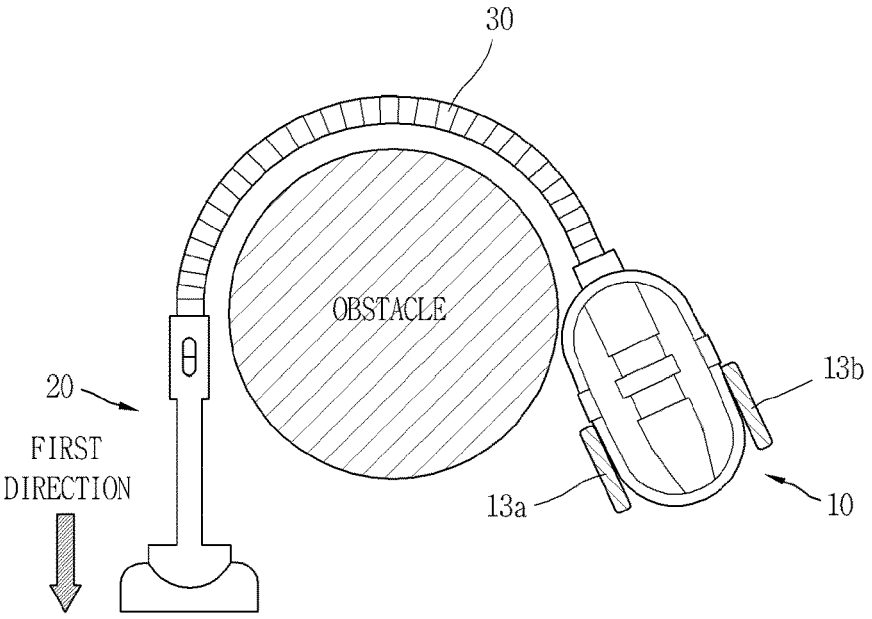

[Fig. 6b]
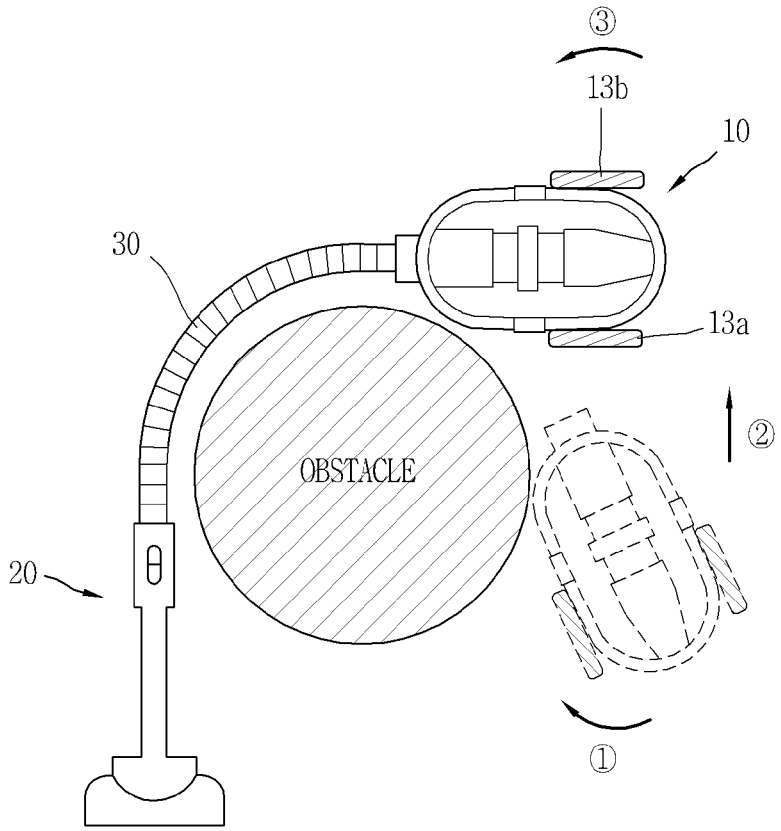
[Fig. 7]
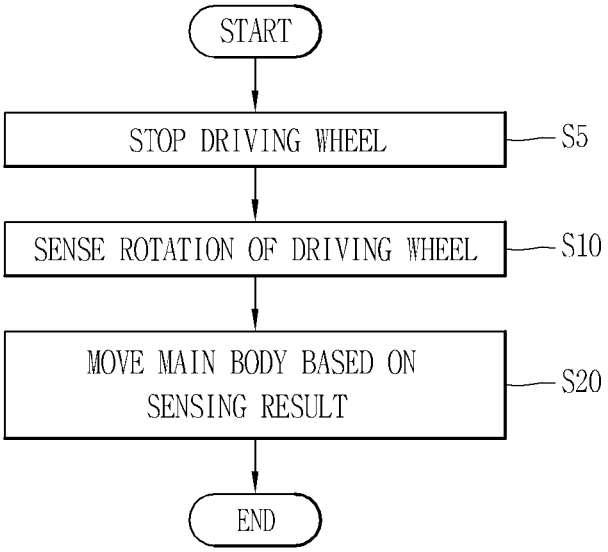

[Fig. 8]
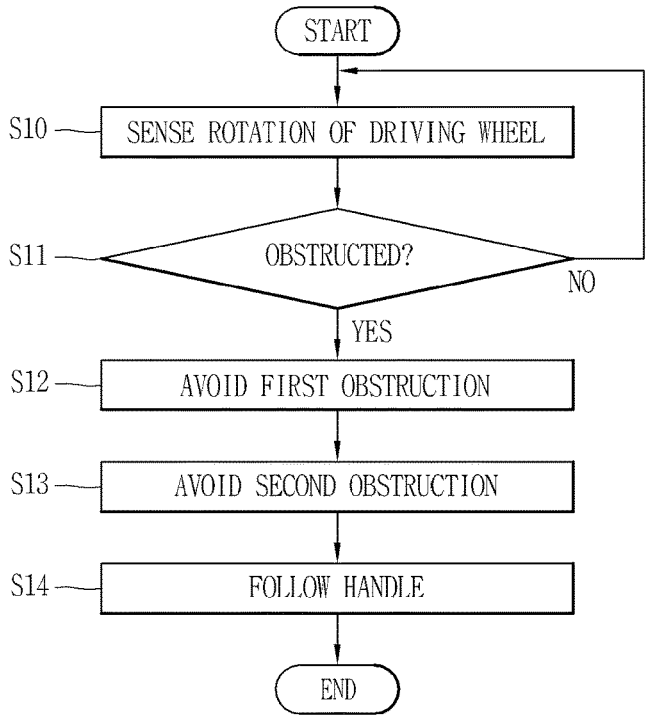
[Fig. 9]
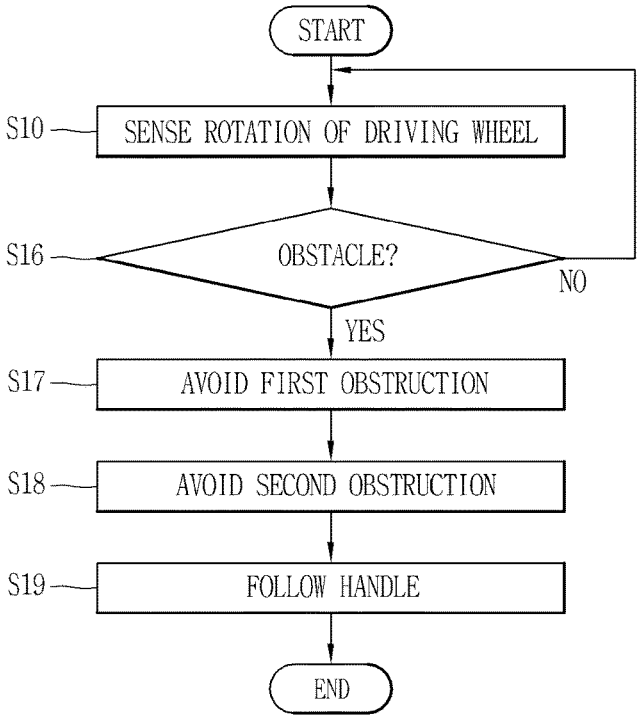

AUTONOMOUS MOBILE CLEANER AND CONTROL METHOD THEREOF

CROSS-REFERENCE TO RELATED APPLICATIONS

This application is a National Stage application under 35 U.S.C. § 371 of International Application No. PCT/KR2015/013344, filed Dec. 8, 2015, which claims the benefit of Korean Application No. 10-2014-0191054, filed on Dec. 26, 2014. The disclosures of the prior applications are incorporated by reference in their entirety.

TECHNICAL FIELD

The present invention relates to a cleaner that recognizes a user's operation intention to move autonomously and a control method thereof.

BACKGROUND ART

Generally, a cleaner such as a vacuum cleaner and a steam cleaner is a device that uses a suction motor installed inside a main body to suck up air including foreign material such as dust, uses a filter inside the main body to remove the foreign material from the air, and discharge the filtered air.

The cleaner may be classified into a canister type in which a suction nozzle for sucking up dust is provided separately from the main body and connected by a connector and an upright type in which a suction nozzle is rotationally connected with the main body.

Generally, a cleaner includes a main body having a suction motor, a suction nozzle configured to suck up air including foreign material of a floor surface, and an air pipe configured to move the air sucked to the suction nozzle to the main body. In this case, while a user moves the suction nozzle, the main body moves along with the suction nozzle.

However, in order for a user to move a cleaner, a force corresponding to a friction force on the bottom surface of the main body is needed, and thus the movement of the cleaner is not easy. That is, since the cleaner does not have a power system for moving the main body, the user should directly move the main body or pull the air pipe to move the main body. In particular, when the user pulls the air pipe to move the main body, a failure may occur such as damage to a pipe connector.

A conventional autonomous mobile cleaner employs a technique of utilizing ultrasonic sensors in a foreign material suction nozzle and a main body, as described the following patent document 1. However, in this case, when there is an obstacle between an ultrasonic transmission unit and an ultrasonic reception unit, the reception of an ultrasonic signal is impossible. In addition, the ultrasonic transmission unit and the ultrasonic reception unit may be blocked by a user, etc. Furthermore, when the cleaner is used in a complicated indoor space, malfunction may occur due to ultrasonic signals reflected by surrounding objects.

Accordingly, there is a need for technology to solve such problems.

DISCLOSURE OF INVENTION

Technical Problem

Therefore, an aspect of the detailed description is to provide an autonomous mobile cleaner that controls the main body of the cleaner to follow a suction unit without using ultrasonic waves unlike conventional techniques, and a control method thereof

Solution to Problem

To achieve these and other advantages and in accordance with the purpose of this specification, as embodied and broadly described herein, there is provided an autonomous mobile cleaner including a main body, a suction unit having a handle and configured to suck up surrounding foreign material, an air pipe configured to connect the main body and the suction unit and guide the foreign material into the main body, at least one driving wheel installed below the main body, a driving unit configured to drive the driving wheel by operating a driving motor, a wheel sensor configured to sense rotation of the driving wheel, and a controller configured to control the movement of the main body through the driving unit based on the rotation of the driving wheel sensed by the wheel sensor.

The controller may control the movement of the main body based on the rotation of the driving wheel sensed by the wheel sensor when the driving wheel is not driven by the driving unit.

The wheel sensor may sense the rotation of the first driving wheel positioned at a left side of the main body and the rotation of the second driving wheel positioned at a right side of the main body, and the controller may individually control the first driving wheel and the second driving wheel based on the rotation of the first driving wheel and the second driving wheel sensed by the wheel sensor.

The controller may drive the first driving wheel and the second driving wheel in the same direction as rotation directions of the first driving wheel and the second driving wheel sensed by the wheel sensor.

The controller may drive the first driving wheel and the second driving wheel according to rotation amounts of the first driving wheel and the second driving wheel sensed by the wheel sensor.

Rotation amounts by which the first driving wheel and the second driving wheel are driven may be greater than the rotation amounts of the first driving wheel and the second driving wheel sensed by the wheel sensor.

The controller may drive the first driving wheel and the second driving wheel such that rotation amounts by which the first driving wheel and the second driving wheel are driven do not exceed a predetermined rotation amount limit.

When a difference between the rotation amount of the first driving wheel and the rotation amount of the second driving wheel which are sensed by the wheel sensor is greater than or equal to a predetermined value or when the rotation direction of the first driving wheel and the rotation direction of the second driving wheel are different from each other, the controller may drive the first driving wheel and the second driving wheel in a predetermined obstruction avoidance pattern and may drive the first driving wheel and the second driving wheel such that the main body follows the suction unit based on the rotation of the first driving wheel and the rotation of the second driving wheel which are sensed by the wheel sensor.

The obstruction avoidance pattern may include a first obstruction avoidance pattern, and when the difference between the rotation of the first driving wheel and the rotation of the second driving wheel is greater than or equal to the predetermined value, the controller may drive only the one of the first driving wheel and the second driving wheel that has a smaller rotation amount or drive the first driving wheel and the second driving wheel such that the one driving wheel have a greater rotation amount than the other driving wheel according to the first avoidance pattern. When the rotation direction of the first driving wheel and the rotation direction of the second driving wheel are different from each other, the controller may drive the first driving wheel and the second driving wheel in directions opposite to the rotation directions of the first driving wheel and the second driving wheel which are sensed by the wheel sensor.

The obstruction avoidance pattern may further include a second obstruction avoidance pattern, and the controller may drive the first driving wheel and the second driving wheel by a predetermined rotation amount in the same rotation direction according to the second obstruction avoidance pattern before or after the first obstruction avoidance pattern.

The autonomous mobile cleaner may further include a bumper sensor provided in the main body and configured to sense a front obstacle, and the controller may drive the first and second driving wheels according to a predetermined obstacle avoidance pattern to avoid the obstacle on the basis of the position of the obstacle sensed by the bumper sensor and may drive the first and second driving wheels such that the main body follows the suction unit based on the rotation of the first driving wheel and the rotation of the second driving wheel that are sensed by the wheel sensor.

The obstacle avoidance pattern may include a first obstacle avoidance pattern, and in order to turn the main body to move in a direction opposite to the position of the obstacle, according to the first obstacle avoidance pattern, the controller may drive only the one of the first driving wheel and the second driving wheel that is closer to the obstacle sensed by the bumper sensor, drive the first and second driving wheels such that the one driving wheel has a greater rotation amount than the other driving wheel, or drive the first and second driving wheels in opposite directions.

The obstacle avoidance pattern may further include a second obstacle avoidance pattern, and the controller may drive the first driving wheel and the second driving wheel by a predetermined rotation amount in the same rotation direction according to the second obstruction avoidance pattern before or after the first obstruction avoidance pattern.

There is also provided a control method of an autonomous mobile cleaner including a main body, a suction unit having a handle and configured to suck up surrounding foreign material, an air pipe configured to connect the main body and the suction unit and guide the foreign material into the main body, at least one driving wheel installed below the main body, and a driving unit configured to drive the driving wheel by operating a driving motor, the control method including sensing rotation of the driving wheel by a wheel sensor, and controlling the movement of the main body through the driving unit based on the sensed rotation of the driving wheel by the controller.

The controller may further include stopping driving the driving wheel.

The sensing of the rotation of the driving wheel may include sensing the rotation of the first driving wheel positioned at a left side of the main body and the rotation of the second driving wheel positioned at a right side of the main body, and the controlling of the movement of the main body may include individually controlling the first driving wheel and the second driving wheel based on the rotation of the first driving wheel and the second driving wheel sensed by the wheel sensor.

The controlling of the movement of the main body may include driving the first driving wheel and the second driving wheel in the same direction as rotation directions of the first driving wheel and the second driving wheel sensed by the wheel sensor.

The controlling of the movement of the main body may include driving the first driving wheel and the second driving wheel according to rotation amounts of the first driving wheel and the second driving wheel sensed by the wheel sensor.

In the controlling of the movement of the main body, rotation amounts by which the first driving wheel and the second driving wheel are driven may be greater than the rotation amounts of the first driving wheel and the second driving wheel sensed by the wheel sensor.

The controlling of the movement of the main body may include driving the first and second driving wheels such that the rotation amounts by which the first and second driving wheels are driven do not exceed a predetermined rotation amount limit.

The controlling of the movement of the main body may include determining whether a difference between the rotation amount of the first driving wheel and the rotation amount of the second driving wheel which are sensed by the wheel sensor is greater than or equal to a predetermined value, when the difference between the rotation amount of the first driving wheel and the rotation amount of the second driving wheel is greater than or equal to the predetermined value, a first obstruction avoidance step of driving only the one of the first driving wheel and the second driving wheel that has the smaller rotation amount or driving the first driving wheel and the second driving wheel such that the one driving wheel has a greater rotation amount than the other driving wheel, and driving the first driving wheel and the second driving wheel such that the main body follows the suction unit based on the rotation of the first driving wheel and the second driving wheel sensed by the wheel sensor.

The controlling of the movement of the main body may include determining whether the rotation direction of the first driving wheel and the rotation direction of the second driving wheel are different from each other, a first driving avoidance step of driving the first driving wheel and the second driving wheel in directions opposite to the rotation directions of the first and second driving wheels sensed by the wheel sensor when the rotation direction of the first driving wheel and the rotation direction of the second driving wheel are different from each other, and driving the first driving wheel and the second driving wheel such that the main body follows the suction unit based on the rotation of the first driving wheel and the second driving wheel sensed by the wheel sensor.

The controlling of the movement of the main body may further include a second obstruction avoidance step of driving the first and second driving wheels by a predetermined rotation amount in the same rotation direction before and/or after the first obstruction avoidance step.

The controlling of the movement of the main body may include sensing a position of an obstacle by a bumper sensor that sense a front obstacle, an obstacle avoidance step of driving the first and second driving wheels according to a predetermined obstacle avoidance pattern to avoid the obstacle on the basis of the position of the sensed obstacle, and driving the first and second driving wheels such that the main body follows the suction unit based on the rotation of the first driving wheel and the rotation of the second driving wheel that are sensed by the wheel sensor.

The avoiding of the obstacle may include a first obstacle avoidance step of driving only the one of the first driving wheel and the second driving wheel that is closer to the obstacle sensed by the bumper sensor, driving the first and second driving wheels such that the one driving wheel has a greater rotation amount than the other driving wheel, or driving the first and second driving wheels in opposite directions in order to turn the main body to move in a direction opposite to the position of the obstacle.

The avoiding of the obstacle may further include a second obstacle avoidance step of driving the first and second driving wheels by a predetermined rotation amount in the same direction before and/or after the first obstruction avoidance step.

There is also provided a computer-readable recording medium storing a computer program for executing the control method of the autonomous mobile cleaner.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

Advantageous Effects of Invention

According to the autonomous mobile cleaner and a control method thereof according to an embodiment of the present invention, it is possible to prevent an ultrasonic signal from being blocked by an obstacle or prevent malfunction from occurring due to an ultrasonic signal reflected by surrounding objects because ultrasonic waves are not used when the main body of the cleaner moves to follow the suction unit.

According to the autonomous mobile cleaner and the control method thereof according to an embodiment of the present invention, it is also possible to minimize an attractive force applied to the main body by the user and remove the possibility that the user receives a shock from the main body by maintaining a predetermined distance between the main body and the suction unit and reduce the possibility that the air pipe is damaged by an external force by minimizing a tension force applied to the air pipe.

BRIEF DESCRIPTION OF DRAWINGS

The accompanying drawings, which are included to provide a further understanding of the invention and are incorporated in and constitute a part of this specification, illustrate exemplary embodiments and together with the description serve to explain the principles of the invention.

In the drawings:

FIG. 1 is a perspective view of an autonomous mobile cleaner according to an embodiment of the present invention;

FIG. 2 is a block diagram for describing an operation of an autonomous mobile cleaner according to an embodiment of the present invention;

FIG. 3 is a block diagram for describing an operation of an autonomous mobile cleaner according to another embodiment of the present invention;

FIG. 4 is a diagram for describing movement of an autonomous mobile cleaner according to an embodiment of the present invention;

FIG. 5A is a diagram showing an example in which an autonomous mobile cleaner is obstructed according to an embodiment of the present invention;

FIGS. 5B and 5C are diagrams showing an example in which a obstructed autonomous mobile cleaner is freed according to an embodiment of the present invention;

FIG. 6A is a diagram showing an example in which an autonomous mobile cleaner meets an obstacle according to an embodiment of the present invention;

FIG. 6B is a diagram showing an example in which an autonomous mobile cleaner moves to avoid an obstacle according to an embodiment of the present invention;

FIG. 7 is a flowchart showing a control method of an autonomous mobile cleaner according to an embodiment of the present invention; and FIGS. 8 and 9 are flowcharts showing a control method of an autonomous mobile cleaner according to another embodiment of the present invention.

BEST MODE FOR CARRYING OUT THE INVENTION

Description will now be given in detail of preferred configurations of an autonomous mobile cleaner and a control method thereof according to the present invention, with reference to the accompanying drawings.

FIG. 1 is a perspective view of an autonomous mobile cleaner according to an embodiment of the present invention.

As shown in FIG. 1, an autonomous mobile cleaner according to an embodiment of the present invention may include a main body 10, a suction unit 20 having a handle and configured to suck up surrounding foreign material, an air pipe 30 configured to connect the main body 10 and the suction unit 20 and guide the foreign material into the main body 10, at least one driving wheel 13 installed below the main body 10, a driving unit 130 configured to drive the driving wheel by operating a driving motor and move the main body to follow the suction unit 20, a wheel sensor 120 configured to sense the rotation of the driving wheel, and a controller 110 configured to control the movement of the main body through the driving unit 130 on the basis of the rotation of the driving wheel sensed by the wheel sensor.

In this case, it will be appreciated that the listed elements are not essential, and the autonomous mobile cleaner may be implemented by elements more or fewer than the listed elements.

Each of the elements will be described below.

The main body 10 may include a dust collection device 15 that is detachably installed. The dust collection device 15 may be called a dust separation device. The dust collection device 15 may be detachably installed in the front of the main body 10. Various filters may be detachably combined with the dust collection device 15. A suction force is created by the rotation of a suction motor. While an air sucked by the created suction force passes through the dust collection device 15, dust is separated from the air and stored in the dust collection device 15.

The suction unit 20 includes a handle 21 for allowing the user to manipulate an operation of the autonomous mobile cleaner. In addition, the suction unit 20 includes a suction head 23 positioned on a floor surface to suck up the foreign material and the air. A suction hole is formed on a bottom surface of the suction head and configured to suck up the foreign material, such as the dust on the floor surface, and the air. An agitator is rotatably formed in the suction hole and configured to guide the foreign material such as dust into the suction hole. The suction unit 20 may further include an extension pipe 25 configured to connect the handle 21 and the suction head 23.

The air pipe 30 may be formed in a foldable shape. In addition, the air pipe 30 may be made of synthetic resin, etc. The air pipe 30 has one side connected to the suction unit 20 and the other side connected to the main body 10, that is, a connection pipe 11.

In addition, the autonomous mobile cleaner according to an embodiment of the present invention may include a power source (not shown) for supplying power to at least one of the elements included in the autonomous mobile cleaner.

The power source may include a battery or a battery pack that may store power supplied from an external power supply device.

In this case, the power source may receive power from the external power supply device in wired/wireless charging methods. That is, the power source may be directly connected with the external power supply device by an element such as a power outlet or wirelessly connected with the external power supply device using any one of a magnetic resonance coupling method, an electromagnetic induction method, and a radio wave method in order to receive the power.

The driving wheel 13 may be installed below the main body 10 and configured to move the main body.

Thus, the driving unit 130 may include a driving motor (not shown) and drive the driving wheel by operating the driving motor according to a driving signal. Here, the driving signal may be a signal for moving the main body 10 forward or backward or rotating or stopping the main body 10.

In addition, the autonomous mobile cleaner according to an embodiment of the present invention may further include an auxiliary wheel, which is not driven by the driving motor, configured to rotate to assist with the driving wheel.

The wheel sensor 120 may sense the rotation of the driving wheel 13.

The wheel sensor 120 may be connected to left and right driving wheels 13 and configured to sense rotation numbers of the left and right driving wheels 13. Here, the wheel sensor 120 may be a rotary encoder. When the main body moves, the rotary encoder may sense the rotation numbers of the left and right driving wheels 13.

The wheel sensor 120 may be used to control the rotation numbers of the driving wheels 13. However, as described below, when a user who grasps a handle included in the suction unit 20 applies an attractive force to the main body 10 through the air pipe 30, the controller 110 may estimate the attractive force of the user that acts on the main body 10.

The controller 110 may use the rotation numbers of the left and right driving wheels, which are output from the wheel sensor 120, to calculate rotation speeds of the left and right driving wheels 13 or may use a difference between the rotation numbers of the left wheel and the right wheel to calculate a rotation angle of the main body.

Accordingly, the controller 110 controls the movement of the main body 10 through the driving unit 130 on the basis of the rotation of the driving wheel, particularly, the rotation number or the rotation speed of the driving wheel. In detail, the controller 110 may determine a user's operation intention (move forward, move backward, or turn) on the basis of the rotation numbers or rotation speeds of the left and right driving wheels 13 sensed by the wheel sensor 120 and may control the rotation of the left and right driving wheels 13 through the driving unit 130 such that the main body 10 follows a handle or the suction unit 20 including the handle according to a result of the determination, and thus the main body 10 may move autonomously according to the user's operation intention.

In order to determine the user's operation intention, the controller 110 does not limit whether the main body 10 moves (or whether the driving unit 130 is driven) when the controller 110 senses the rotation of left and right driving wheels through the wheel sensor 120. In detail, according to an embodiment, when the driving wheel 13 is not driven by the driving unit 130, the controller 110 may determine the user's operation intention on the basis of the rotation numbers or rotation speeds of the left and right driving wheels sensed by the wheel sensor 120 and may control the movement of the main body 10 according to the determination. In addition, according to another embodiment, while the driving wheel 13 is driven by the driving unit 130, the controller 110 may determine the user's operation intention on the basis of a difference between a driving signal transferred to the driving unit 130 and the rotation numbers or rotation speeds of the driving wheels sensed by the wheel sensor 120, and thus may control the movement of the main body 10. In addition, according to another embodiment, before sensing the rotation of the driving wheel 13 through the wheel sensor 120, the controller 110 may transfer a stop signal to the driving unit 130 to stop the rotation of the driving wheel 13, sense the rotation number of the driving wheel through the wheel sensor 120, and determine the user's operation intentions on the basis of the sensed rotation number.

The wheel sensor 120 may sense and output the rotation of a first driving wheel 13*a* positioned at a left side and the rotation of a second driving wheel 13*b* positioned at a right side on the basis of a traveling direction of the main body 10, that is, a direction (hereinafter referred to as a forward direction) in which the air pipe 30 for connecting with the suction unit 20 is combined.

Thus, the controller 110 may individually control the first and second driving wheels 13 through the driving unit 130 on the basis of the rotation (as an example, rotation directions or rotation amounts) of the first and second driving wheels 13 sensed by the wheel sensor 120. Here, the number and positions of driving wheels may be changed depending on the design. The main body 10 may move (e.g., travel in a straight line, travel in a curve, or turn) by the first and second driving wheels 13 that are driven independently.

In detail, the controller 110 may drive the first driving wheel 13*a* and the second driving wheel 13*b* on the basis of the rotation direction sensed by the wheel sensor 120. In this case, the first and second driving wheels 13 may rotate in the same direction as that of the first and second driving wheels 13 sensed by the wheel sensor 120 such that the main body 10 moves to follow the suction unit 20.

In addition, the controller 110 may drive the first driving wheel 13*a* and the second driving wheel 13*b* on the basis of the rotation amount (which may indicate a physical quantity including the rotation number or rotation speed) sensed by the wheel sensor 120. However, the controller 110 may control the rotation of the driving wheels using a rotation amount greater than the rotation amount sensed by the wheel sensor 120. That is, in order to reduce the force with which the user pulls the main body 10 through the handle, the main body 10 may move by a rotation amount greater than the sensed rotation amount.

As an example, as shown in FIG. 4, when an attractive force is applied from the suction unit 20 to the main body 10 in a first direction, the wheel sensor 120 senses the rotation of the first driving wheel 13*a* and the second driving wheel

13*b*, which rotate by the same rotation amount in the same direction (a direction in which the driving wheel 13 rotates when the main body moves in a forward direction). The controller 110 may control the first driving wheel 13*a* and the second driving wheel 13*b* to be driven by a rotation amount greater than the rotation amount sensed from the first driving wheel 13*a* and the second driving wheel 13*b* in the same direction as the sensed rotation direction, thus allowing the main body 10 to move in the first direction.

As another example, as shown in FIG. 4, when an attractive force is applied from the suction unit 20 to the main body 10 in a second direction (or third direction), the wheel sensor 120 senses the rotation of the first driving wheel 13*a* and the second driving wheel 13*b*, which rotate by different rotation amounts in the same direction (a direction in which the driving wheel 13 rotates when the main body moves in a forward direction) or senses the rotation of the first driving wheel 13*a* and the second driving wheel 13*b*, which rotate by the same or different rotation amounts in different directions along the second direction. The controller 110 may control the first driving wheel 13*a* and the second driving wheel 13*b* to be driven by a rotation amount greater than the rotation amount sensed from the first driving wheel 13*a* and the second driving wheel 13*b* in the same direction as the sensed rotation direction, thus allowing the main body 10 to turn and/or move in the second direction (or third direction).

As another example, as shown in FIG. 4, when a repulsive force is applied from the suction unit 20 to the main body 10 in a fourth direction, the wheel sensor 120 senses the rotation of the first driving wheel 13*a* and the second driving wheel 13*b*, which rotate by the same rotation amount in the same direction (a direction in which the driving wheel 13 rotates when the main body moves in a backward direction). The controller 110 may control the first driving wheel 13*a* and the second driving wheel 13*b* to be driven by a rotation amount greater than the rotation amount sensed from the first driving wheel 13*a* and the second driving wheel 13*b* in the same direction as the sensed rotation direction, thus allowing the main body 10 to move in the fourth direction.

In this case, the controller 110 may drive the first and second driving wheels 13 such that the rotation amount by which the first and second driving wheels 13 are driven does not exceed a predetermined rotation amount limit.

That is, when the controller 110 drives the driving wheel 13 through the driving unit 130 on the basis of the rotation amount sensed by the wheel sensor 120, the controller 110 may control the first and second driving wheels 13 such that the rotation number or the rotation speed does not exceed a predetermined rotation number limit or a predetermined rotation speed limit, respectively, thus allowing the user to prevent a shock from being applied from the main body 10 and prevent an air pipe from being tangled by the rotation of the main body.

Here, the rotation amount limit may be set as the rotation amount of the first driving wheel 13*a* and/or the second driving wheel 13*b* per one cycle when a series of processes in which the wheel sensor 120 senses the rotation amount of the driving wheel 13 and the driving unit 130 drives the driving wheel according to the sensed rotation amount are considered as one cycle.

When the controller 110 controls the movement of the main body 10 such that the main body 10 follows the suction unit 20, the controller 110 may control the driving unit 130 such that a distance between the suction unit 20 including a handle grasped by the user and the main body 10 is maintained at a predetermined distance (or in a certain distance range) on the basis of the rotation numbers or rotation speeds of the left and right driving wheels 13 sensed by the wheel sensor 120.

Here, the predetermined distance may be set in advance or by the user's input. The predetermined distance may be set at a certain ratio on the basis of the length of the air pipe 30. As an example, when the length of the air pipe is received from the user, the controller 110 may set a value calculated by applying a certain ratio corresponding to the received length of the air pipe as the predetermined distance.

An autonomous mobile cleaner according to an embodiment of the present invention may determine whether the movement of the main body 10 is restricted and may perform avoidance steering to remove an element for restricting the movement according to a result of the determination and thus allow the main body 10 to continuously follow the suction unit 20.

According to an embodiment, the controller 110 may determine that the main body 10 is obstructed when a difference between the rotation amounts of the driving wheels sensed by the wheel sensor 120 is greater than or equal to a predetermined value or the rotation directions of the driving wheels are different from each other.

FIG. 5A is a diagram showing an example in which an autonomous mobile cleaner is obstructed according to an embodiment of the present invention.

As shown in FIG. 5A, when the main body 10 has one side that is in contact with a wall, and a user pull the suction unit 20 in a first direction, there may be a difference in rotation amount and/or rotation direction between the first driving wheel 13*a* and the second driving wheel 13*b* sensed through the wheel sensor 120.

In the main body 10, an attractive force in the first direction may cause the rotation amount of the first driving wheel 13*a* installed adjacent to the wall to be smaller than the rotation amount of the second driving wheel 13*b* installed in another position and may cause the rotation direction of the first driving wheel 13*a* to be opposite to the rotation direction of the second driving wheel 13*b*.

Accordingly, when a difference between the rotation amount of the first driving wheel 13*a* and the rotation amount of the second driving wheel 13*b* sensed through the wheel sensor 120 is greater than or equal to a predetermined value, and the rotation direction of the first driving wheel 13*a* and the rotation direction of the second driving wheel 13*b* are different from each other, the controller 110 may determine that the main body 10 is obstructed and may drive the first and second driving wheels 13 in a predetermined obstruction avoidance pattern or move the main body 10 in the obstruction avoidance pattern such that the main body is free from the obstruction and then follows the suction unit 20.

The obstruction avoidance pattern may include a first obstruction avoidance pattern and/or a second obstruction avoidance pattern.

When the difference between the rotation amount of the first driving wheel 13*a* and the rotation amount of the second driving wheel 13*b* is greater than or equal to a predetermined value, the controller 110 drives only the one of the first and second driving wheels 13 that has the smaller rotation amount or drives the first and second driving wheels 13 such that the one driving wheel has a greater rotation amount than the other driving wheel. When the rotation direction of the first driving wheel 13*a* and the rotation direction of the second driving wheel 13*b* are different from each other, the controller 110 may drive the first driving wheel 13*a* and the second driving wheel 13*b* in opposite directions to the rotation directions of the first driving wheel 13*a* and the second driving wheel 13*b* sensed by the wheel sensor 120.

In addition, the controller 110 may drive the first driving wheel 13*a* and the second driving wheel 13*b* by a predetermined rotation amount in the same direction according to the second obstruction avoidance pattern before or after the first obstruction avoidance pattern to move the main body 10 forward or backward.

That is, the controller 110 may move the main body 10 backward by a predetermined distance such that the main body 10 rotates easily according to the first obstruction avoidance pattern by controlling the movement of the main body 10 according to the second obstruction avoidance pattern before the first obstruction avoidance pattern. In addition, the controller 110 may secure a traveling direction in which the main body 10 avoids the obstruction according to the first obstruction avoidance pattern and may free the main body 10 from the obstruction according to the second obstruction avoidance pattern by controlling the movement of the main body 10 according to the second obstruction avoidance pattern after the first obstruction avoidance pattern.

Subsequently, the controller 110 may drive the driving wheel 13 on the basis of the rotation amount sensed by the wheel sensor 120 such that the main body 10 follows the suction unit 20 including a handle.

As an example, as shown in FIG. 5B, in order to free the obstructed main body 10 from the obstruction, the controller 110, since the rotation amount of the first driving wheel 13*a* positioned adjacent to the wall is smaller than the rotation amount of the second driving wheel 13*b*, the controller 110 may allow the main body 10 to rotate in direction ① by driving the first and second driving wheels 13 in a forward direction such that the rotation amount of the first driving wheel 13*a*, which has been smaller than that of the second driving wheel 13*b*, is greater than the rotation amount of the second driving wheel 13*b*.

On the other hand, since the rotation direction of the first driving wheel 13*a* is sensed as a direction opposite to the forward direction, or the rotation direction of the second driving wheel 13*b* is sensed as the forward direction through the wheel sensor 120, the controller 110 may allow the main body 10 to rotate in direction ① by driving the first and second driving wheels 13 in opposite directions to the sensed rotation directions of the first and second driving wheels 13.

Subsequently, the controller 110 may allow the main body 10 to turn to move in direction ② by driving the first and second driving wheels 13 by a predetermined rotation amount in the forward direction such that the main body 10 moves forward by a predetermined distance, and thus may free the main body 10 from the obstruction.

Subsequently, the controller 110 may allow the main body to turn to move in direction ③ by driving the driving wheel 13 on the basis of the rotation amount sensed by the wheel sensor 120.

As described above, the controller 110 may control the driving wheels 13 such that the main body 10 moves backward by a predetermined distance before controlling the driving wheel 13 such that the main body 10 rotates in direction ①.

The autonomous mobile cleaner according to an embodiment of the present invention may further include a bumper sensor 17.

As shown in FIGS. 1 and 3, the bumper sensor 17 may include the main body 10 and sense an obstacle in front of the bumper sensor 17.

The bumper sensor 17 may be installed along an outer surface of the main body 10. A plurality of bumper sensors 17*a* to 17*d* may be arranged and installed at certain distances.

As shown in FIG. 3, the plurality of bumper sensors 17 may be installed at predetermined distances in left and right sides with respect to the position of the connection pipe 11 included in the main body 10. In this case, the number or positions of bumper sensors 17 installed in the main body 10 are not especially limited.

Each of the bumper sensors 17 may sense an object or obstacle in front and may transfer the sensed information to the controller 110. The bumper sensor 17 may sense furniture, a wall, or the like to transfer the sensed information to the controller 110.

Examples of the bumper sensor 17 include an infrared sensor, an ultrasonic sensor, an RF sensor, a position sensitive device (PSD), and so on. The bumper sensor 17 installed in the main body 10 may use one kind of sensor or two kinds of sensors as needed.

In general, the ultrasonic sensor is mainly used to sense a remote obstacle and may determine whether there is an obstacle by determining whether ultrasonic waves emitted through an emission unit are reflected by an obstacle and received by a reception unit and calculating a distance to the obstacle using the reception time. In this case, a transmission ultrasonic sensor and a reception ultrasonic sensor may be arranged and installed alternately on the outer surface of the main body 10.

The PSD sensor may use semiconductor surface resistance to detect a short-long-distance position of incident light with one p-n junction. The PSD sensor includes a one-dimensional PSD sensor that detects light in only one axis direction and a two-dimensional PSD sensor that detects a light spot on a plane surface, both of which have a pin photodiode structure. The PSD sensor, which is a kind of infrared sensor, emits infrared light to an obstacle to sense the obstacle and measures a distance using the time for the light to be reflected back. The PSD sensor includes a light emitting unit that emits the infrared light to the obstacle and light receiving unit that receives the infrared light that is reflected back from the obstacle and is generally configured as a module. The PSD sensor may obtain a stable measured value, irrespective of the reflectivity of the obstacle and the distance in color.

Thus, the autonomous mobile cleaner according to an embodiment of the present invention may drive the first and second driving wheels 13 according to a predetermined obstacle avoidance pattern such that the obstacle is avoided on the basis of the position of the obstacle sensed by the bumper sensor, and subsequently may drive the first and second driving wheels 13 such that the main body 10 follows the suction unit 20.

The obstacle avoidance pattern may include a first obstacle avoidance pattern and/or a second obstacle avoidance pattern.

In order to move the main body 10 in a direction opposite to the position of the obstacle according to the first obstacle avoidance pattern, the controller 110 may drive only the one of the first and second driving wheels 13 that is closer to the obstacle sensed by the bumper sensor 17, drive the first and second driving wheels 13 such that the one driving wheel has a greater rotation amount than the other driving wheel, or drive the first and second driving wheels in opposite directions.

In addition, the controller 110 may drive the first driving wheel 13*a* and the second driving wheel 13*b* by a predetermined rotation amount in the same direction according to the second obstacle avoidance pattern before or after the first obstacle avoidance pattern to move the main body 10 forward or backward.

That is, the controller 110 may move the main body 10 backward by a predetermined distance such that the main body 10 rotates easily according to the first obstacle avoidance pattern by controlling the movement of the main body 10 according to the second obstacle avoidance pattern before the first obstacle avoidance pattern. In addition, the controller 110 may secure a traveling direction in which the main body 10 avoids the obstacle according to the first obstacle avoidance pattern and may free the main body 10 from the obstacle according to the second obstacle avoidance pattern by controlling the movement of the main body 10 according to the second obstacle avoidance pattern after the first obstacle avoidance pattern.

Subsequently, the controller 110 may drive the driving wheel 13 on the basis of the rotation amount sensed by the wheel sensor 120 such that the main body 10 follows the suction unit 20 including a handle.

As an example, as shown in FIG. 6A, when the obstacle is positioned in one side of the main body 10, the controller 110 may sense the obstacle through the bumper sensor 17.

A bumper sensor represented as reference number 17*a* among the plurality of bumper sensors 17*a* to 17*d* may sense the obstacle. Thus, in order for the main body 10 to avoid the obstacle upon movement, the controller 110 may rotates the main body 10 in a direction opposite to the position of the obstacle. In detail, the controller 110 may rotate the main body 10 in direction ① by driving only the first driving wheel 13*a* close to the obstacle positioned in front of the bumper sensor represented as reference number 17 in a forward direction, driving the first and second driving wheels 13 in a forward direction such that the first driving wheel 13*a* has a greater than the second driving wheel 13*b*, or driving the first and second driving wheels in opposite directions.

Subsequently, the controller 110 may drive the first and second driving wheels 13 by a predetermined rotation amount in the forward direction such that the main body 10 moves forward by a predetermined distance, and thus the main body 10 may move in direction ② and thus pass by the obstacle.

Subsequently, the controller 110 may allow the main body 10 to turn to move in direction ② by driving the driving wheel 13 on the basis of the rotation amount sensed by the wheel sensor 120.

As described above, the controller 110 may control the driving wheels 13 such that the main body 10 moves backward by a predetermined distance before controlling the driving wheel 13 such that the main body 10 rotates in direction CD.

As described above, in an autonomous mobile cleaner according to another embodiment, the controller 110 may determine whether the main body 10 is obstructed by the obstacle by the bumper sensor 17 and may drive the first and second driving wheels 13 through the driving unit 130 to free the main body 10 from the obstruction accord to a result of the determination.

That is, the controller 110 may determine whether the main body 10 is obstructed not on the basis of the rotation amounts or rotation directions of the first and second driving wheels 13 but through the bumper sensor 17. According to a result of the determination, the main body 10 may be free from the obstruction.

The description thereof is the same as described with reference to FIGS. 5A to 5C. Thus, the detailed description thereof will be omitted.

When the controller 110 receives obstacle detection information from the plurality of bumper sensors 17, the controller 110 may calculate distances from the main body 10 to a plurality of obstacles and may control the driving wheels 13 such that the main body 10 moves to preferentially avoid the closest obstacle according to the obstacle avoidance pattern on the basis of information regarding the plurality of distances. Subsequently, by repeating the obstacle detection and the obstacle avoidance pattern, the controller 110 may move the main body 10 such that the main body 10 is not obstructed by the obstacle but avoids the obstacle.

In addition, when the controller 110 receives the obstacle detection information from the bumper sensors 17*a* and 17*c* (see FIG. 3) positioned in the forward direction, that is, the bumper sensors positioned in the left and right sides with respect to a forward direction, the controller 110 may calculate distances from the main body 10 to obstacles. Thus, the controller 110 may calculate distances between the obstacles through triangulation using positions in which the bumper sensors are installed and/or angles at which the bumper sensors sense the obstacles. Accordingly, when the prestored full width (as an example, the greatest width) of the main body 10 is greater than the distance between the obstacles, the controller 110 may visually or audibly warn the user that the main body 10 cannot pass between the obstacles through various warning means.

The suction unit 20 may include a plurality of buttons (not shown) positioned around the handle 21 and configured to control the movement of the main body 10. Thus, the suction unit 20 may transmit a control signal corresponding to a direction button entered from the user to the main body 10 by wire or wirelessly. Upon receiving the control signal, the main body 10 may move forward, backward, left, or right according to the received signal.

When an input event has occurred through the direction button from the user, the main body 10 may stop moving according to the above-described obstruction avoidance pattern or obstacle avoidance pattern and then move in any direction according to the user input. Accordingly, when the main body 10 is obstructed by the obstacle or the like, the user may arbitrarily move the main body 10, thus freeing the main body 10 from the obstruction.

Control Method of Autonomous Mobile Cleaner

FIG. 7 is a flowchart showing a control method of an autonomous mobile cleaner according to an embodiment of the present invention.

As shown in FIG. 7, the control method of the autonomous mobile cleaner according to an embodiment of the present invention may include sensing rotation of a driving wheel (S10) and controlling movement of a main body of the cleaner through a driving unit on the basis of the sensed rotation of the driving wheel (S20).

The elements will be described in detail below with reference to FIGS. 1 to 6B. Repetitive description on the same elements as those described above will not be provided and detailed description thereof will be omitted.

First, the wheel sensor 120 may sense the rotation of the driving wheel 13 (S10), and the controller 110 may control the movement of the main body 10 through the driving unit 130 on the basis of the sensed rotation of the driving wheel 13 (S20).

The controller 110 may determine a user's operation intention (move forward, move backward, or turn) on the basis of the rotation numbers or rotation speeds of the left and right driving wheels 13 sensed by the wheel sensor 120 and may control the rotation of the left and right driving wheels 13 through the driving unit 130 such that the main body 10 follows a handle or the suction unit 20 including the handle according to a result of the determination, and thus the main body 10 may move autonomously according to the user's operation intention.

In order to determine the user's operation intention, the controller 110 does not limit whether the main body 10 moves (or whether the driving unit 130 is driven) when the controller 110 senses the rotation of left and right driving wheels through the wheel sensor 120. However, according to an embodiment, the control method may further include stopping driving the driving wheel 13 (S5) before sensing the rotation of the driving wheel 13 (S10). That is, according to an embodiment, before sensing the rotation of the driving wheel 13 through the wheel sensor 120, the controller 110 may transfer a stop signal to the driving unit 130 to stop the rotation of the driving wheel 13, sense the rotation number of the driving wheel through the wheel sensor 120, and determine the user's operation intentions on the basis of the sensed rotation number.

Alternatively, according to another embodiment, while the driving wheel 13 is driven by the driving unit 130, the controller 110 may determine the user's operation intention on the basis of a difference between a driving signal transferred to the driving unit 130 and the rotation number or rotation speed of the driving wheel sensed by the wheel sensor 120 and may control the movement of the main body 10 according to the determination.

In the sensing of the rotation of the driving wheel 13 (S10), the wheel sensor 120 may sense and output the rotation of a first driving wheel 13*a* positioned in a left side and the rotation of a second driving wheel 13*b* positioned in a right side with respect to a forward direction of the main body 10.

Thus, in the controlling of the movement of the main body (S20), the controller 110 may individually control the first and second driving wheels 13 through the driving unit 130 on the basis of the rotation (as an example, rotation directions or rotation amounts) of the first and second driving wheels 13 sensed by the wheel sensor 120.

In this case, the controlling of the movement of the main body (S20), the controller 110 may drive the first and second driving wheels 13 in the same direction as the rotation direction of the first and second driving wheels 13 sensed by the wheel sensor 120.

In addition, in the controlling of the movement of the main body (S20), the controller 110 may drive the first driving wheel 13*a* and the second driving wheel 13*b* on the basis of the rotation amounts sensed by the wheel sensor 120. However, the controller 110 may control the rotation of the driving wheels using a rotation amount greater than the rotation amount sensed by the wheel sensor 120. That is, in order to reduce the force with which the user pulls the main body 10 through the handle, the main body 10 may move by a rotation amount greater than the sensed rotation amount.

In this case, in the controlling of the movement of the main body (S20), the controller 110 may drive the first and second driving wheels 13 such that the rotation amount by which the first and second driving wheels 13 are driven does not exceed a predetermined rotation amount limit.

That is, when the controller 110 drives the driving wheel 13 through the driving unit 130 on the basis of the rotation amount sensed by the wheel sensor 120, the controller 110 may control the first and second driving wheels 13 such that the rotation number or the rotation speed does not exceed a predetermined rotation number limit or a predetermined rotation speed limit, respectively, thus allowing the user to prevent a shock from being applied from the main body 10 and prevent an air pipe from being tangled by the rotation of the main body.

Here, the rotation amount limit may be set as the rotation amount of the first driving wheel 13*a* and/or the second driving wheel 13*b* per one cycle when a series of processes in which the wheel sensor 120 senses the rotation amount of the driving wheel 13 and the driving unit 130 drives the driving wheel according to the sensed rotation amount are considered as one cycle.

When the controller 110 controls the movement of the main body 10 such that the main body 10 follows the suction unit 20, the controller 110 may control the driving unit 130 such that a distance between the suction unit 20 including a handle grasped by the user and the main body 10 is maintained at a predetermined distance (or in a certain distance range) on the basis of the rotation numbers or rotation speeds of the left and right driving wheels 13 sensed by the wheel sensor 120.

Here, the predetermined distance may be set in advance or by the user's input. The predetermined distance may be set at a certain ratio on the basis of the length of the air pipe 30. As an example, when the length of the air pipe is received from the user, the controller 110 may set a value calculated by applying a certain ratio corresponding to the received length of the air pipe as the predetermined distance.

An autonomous mobile cleaner according to an embodiment of the present invention may determine whether the movement of the main body 10 is restricted and may perform avoidance steering to remove an element for restricting the movement according to a result of the determination and thus allow the main body 10 to continuously follow the suction unit 20.

According to an embodiment, the controller 110 may determine that the main body 10 is obstructed when a difference between the rotation amounts of the driving wheels sensed by the wheel sensor 120 is greater than or equal to a predetermined value or the rotation directions of the driving wheels are different from each other.

Accordingly, the controlling of the movement of the main body (S20) may further include determining whether the main body 10 is obstructed.

Here, in the determining of whether the main body 10 is obstructed (S11), the controller 110 may determine that the main body 10 is obstructed when a difference between the rotation amount of the first driving wheel and the rotation amount of the second driving sensed by the wheel sensor 120 is greater than or equal to a predetermined value.

Subsequently, when it is determined that the main body 10 is obstructed, the controlling of the movement of the main body (S20) may further include a first obstruction avoidance step (S12) in which the controller 110 drives only the one of the first and second driving wheels that has the smaller rotation amount or drive the first and second driving wheels 13 such that the one driving wheel has a greater than the other driving wheel and a second obstruction avoidance step (S13) in which the controller 110 drives the first and second driving wheels 13 by a predetermined rotation amount in the same rotation direction before and/or after the first obstruction avoidance step (S12). That is, FIG. 8 shows that the second obstruction avoidance step (S13) is after the first obstruction avoidance step (S12). However, the first obstruction avoidance step (S12) may be after the second obstruction avoidance step (S13). Before the main body 10 turns to move in the first obstruction avoidance step (S12), first, the main body 10 may move backward by a predetermined distance in the second obstruction avoidance step (S13) so that the main body 10 may easily turn to move in next step which is the first obstruction avoidance step S12.

On the other hand, in the determining of whether the main body 10 is obstructed (S11), the controller 110 may determine that the main body 10 is obstructed when the rotation direction of the first driving wheel and the rotation direction of the second driving wheel are different from each other.

Subsequently, when it is determined that the main body 10 is obstructed, the control method may further include a first obstruction avoidance step (S12) in which the controller 110 drives the first and second driving wheels 13 in directions opposite to the rotation directions of the first and second driving wheels 13 sensed by the wheel sensor 120 and a second obstruction avoidance step (S13) in which the controller 110 drives the first and second driving wheels 13 by a predetermined rotation amount in the same rotation direction before and/or after the first obstruction avoidance step (S12).

Subsequently, the control method may further include driving the first and second driving wheels 13 such that the main body 10 follows the suction unit 20 on the basis of the rotation of the first driving wheel and the rotation of the second driving wheel sensed by the wheel sensor 120.

The detailed description thereof is the same as described with reference to FIGS. 5A to 5C, and thus will be omitted.

The autonomous mobile cleaner according to an embodiment of the present invention may further include a bumper sensor 17. Thus, the controlling of the movement of the main body (S20) may include sensing the position of a front obstacle by the bumper sensor that senses the obstacle (S16).

When the position of the obstacle is sensed, the controlling of the movement of the main body (S20) may include obstacle avoidance steps (S17, S18) of the controller 110 driving the first and second driving wheels 13 according an obstacle avoidance pattern that is predetermined to avoid the obstacle on the basis of the sensed position of the obstacle.

The obstacle avoidance steps may include a first obstacle avoidance step S17 in which, in order to move the main body 10 in a direction opposite to the position of the obstacle, the controller 110 drives only the one of the first and second driving wheels 13 that is closer to the obstacle sensed by the bumper sensor 17, drive the first and second driving wheels 13 such that the one driving wheel has a greater rotation amount than the other driving wheel, or drive the first and second driving wheels 13 in opposite directions and a second obstacle avoidance step S18 in which the controller 110 drives the first and second driving wheels 13 by a predetermined rotation amount in the same rotation direction before or after the first obstacle avoidance step S17.

That is, FIG. 9 shows that the second obstacle avoidance step (S18) is after the first obstacle avoidance step (S17). However, the first obstacle avoidance step (S17) may be after the second obstacle avoidance step (S18). Before the main body 10 turns to move in the first obstacle avoidance step (S17), first, the main body 10 may move backward by a predetermined distance in the second obstacle avoidance step (S18) so that the main body 10 may easily turn to move in the next step which is the first obstacle avoidance step (S17).

Subsequently, the controlling of the movement of the main body (S20) may include driving the first and second driving wheels 13 such that the main body 10 follows the suction unit 20 on the basis of the rotation of the first driving wheel and the rotation of the second driving wheel sensed by the wheel sensor 120.

The detailed description thereof is the same as described with reference to FIGS. 6A and 6B, and thus will be omitted.

The control method of the autonomous mobile cleaner according to an embodiment of the present invention may include, when the controller 110 receives obstacle detection information from the plurality of bumper sensors 17, calculating distances from the main body 10 to a plurality of obstacles and controlling the driving wheels 13 such that the main body 10 moves to preferentially avoid the closest obstacle according to the obstacle avoidance pattern on the basis of information regarding the plurality of distances. Subsequently, by repeating the obstacle detection and the obstacle avoidance pattern, the controller 110 may move the main body 10 such that the main body 10 is not obstructed by the obstacle but avoids the obstacle.

The control method of the autonomous mobile cleaner according to an embodiment of the present invention may further include, when the controller 110 receives the obstacle detection information from the bumper sensors 17*a* and 17*c* (see FIG. 3) positioned in the forward direction, that is, the bumper sensors positioned in the left and right sides with respect to a forward direction, calculating distances from the main body 10 to obstacles, calculating distances between the obstacles through triangulation using positions in which the bumper sensors are installed and/or angles at which the bumper sensors sense the obstacles, and when the prestored full width (as an example, the greatest width) of the main body 10 is greater than the distance between the obstacles, visually or audibly warning the user that the main body 10 cannot pass between the obstacles through various warning means.

According to the autonomous mobile cleaner and a control method thereof according to an embodiment of the present invention, it is possible to prevent an ultrasonic signal from being blocked by an obstacle or prevent malfunction from occurring due to an ultrasonic signal reflected by surrounding objects because ultrasonic waves are not used when the main body of the cleaner moves to follow the suction unit.

According to the autonomous mobile cleaner and the control method thereof according to an embodiment of the present invention, it is also possible to minimize an attractive force applied to the main body by the user and remove the possibility that the user receives a shock from the main body by maintaining a predetermined distance between the main body and the suction unit and reduce the possibility that the air pipe is damaged by an external force by minimizing a tension force applied to the air pipe.

Various embodiments may be implemented using a machine-readable medium having instructions stored thereon for execution by a processor to perform various methods presented herein. Examples of possible machine-readable mediums include HDD (Hard Disk Drive), SSD (Solid State Disk), SDD (Silicon Disk Drive), ROM, RAM, CD-ROM, a magnetic tape, a floppy disk, an optical data storage device, the other types of storage mediums presented herein, and combinations thereof. If desired, the machine-readable medium may be realized in the form of a carrier wave (for example, a transmission over the Internet).

According to the autonomous mobile cleaner and the control method thereof according to an embodiment of the present invention, it is possible to sense and avoid an obstacle when the main body of the cleaner is positioned in a place where the movement of the cleaner may be obstructed by the obstacle.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. An autonomous mobile cleaner comprising:

a main body;

a suction unit having a handle and provided separately from the main body, the suction unit being configured to suck up foreign material;

an air pipe configured to connect the main body and the suction unit and guide the foreign material into the main body;

a first driving wheel installed at a first side of the main body and a second driving wheel installed at a right second side of the main body, the second side being opposite the first side;

a driving unit configured to drive the first and second driving wheels by operating a driving motor;

a wheel sensor connected to the first driving wheel and the second driving wheel and configured to sense rotation of the first driving wheel and the second driving wheel; and a controller configured to control movement of the main body through the driving unit based on the rotation of the driving wheels sensed by the wheel sensor, wherein, when a difference between the rotation amount of the first driving wheel and the rotation amount of the second driving wheel which are sensed by the wheel sensor is greater than or equal to a predetermined value or when the rotation direction of the first driving wheel and the rotation direction of the second driving wheel are different from each other, the controller registers a location of an obstruction and drives the first driving wheel and the second driving wheel in a predetermined obstruction avoidance pattern to avoid the obstruction.

2. The autonomous mobile cleaner of claim 1, wherein the controller controls the movement of the main body based on the rotation of the driving wheels sensed by the wheel sensor according to an external input.

3. The autonomous mobile cleaner of claim 1, wherein the controller drives the first driving wheel and the second driving wheel in the same direction as rotation directions of the first driving wheel and the second driving wheel sensed by the wheel sensor.

4. The autonomous mobile cleaner of claim 1, wherein the controller drives the first driving wheel and the second driving wheel according to rotation amounts of the first driving wheel and the second driving wheel sensed by the wheel sensor.

5. The autonomous mobile cleaner of claim 4, wherein rotation amounts by which the first driving wheel and the second driving wheel are driven are greater than the rotation amounts of the first driving wheel and the second driving wheel sensed by the wheel sensor.

6. The autonomous mobile cleaner of claim 4, wherein the controller drives the first driving wheel and the second driving wheel such that rotation amounts by which the first driving wheel and the second driving wheel are driven do not exceed a predetermined rotation amount limit.

7. The autonomous mobile cleaner of claim 1, wherein the controller drives the first driving wheel and the second driving wheel such that the main body follows the suction unit based on the rotation of the first driving wheel and the rotation of the second driving wheel which are sensed by the wheel sensor.

8. The autonomous mobile cleaner of claim 1, wherein, the obstruction avoidance pattern includes a first obstruction avoidance pattern, and when the difference between the rotation of the first driving wheel and the rotation of the second driving wheel is greater than or equal to the predetermined value, the controller drives only the one of the first driving wheel and the second driving wheel that has a smaller rotation amount or drives the first driving wheel and the second driving wheel such that the one driving wheel has a greater rotation amount than the other driving wheel according to the first obstruction avoidance pattern.

9. The autonomous mobile cleaner of claim 8, wherein, when the rotation direction of the first driving wheel and the rotation direction of the second driving wheel are different from each other, the controller drives the first driving wheel and the second driving wheel in directions opposite to the rotation directions of the first driving wheel and the second driving wheel which are sensed by the wheel sensor.

10. The autonomous mobile cleaner of claim 9, wherein, the obstruction avoidance pattern further includes a second obstruction avoidance pattern, and the controller drives the first driving wheel and the second driving wheel by a predetermined rotation amount in the same rotation direction according to the second obstruction avoidance pattern before or after the first obstruction avoidance pattern.

11. The autonomous mobile cleaner of claim 1, further comprising a bumper sensor provided in the main body and configured to sense a front obstacle, wherein the controller drives the first and second driving wheels according to a predetermined obstacle avoidance pattern to avoid the front obstacle on the basis of the position of the front obstacle sensed by the bumper sensor and drives the first and second driving wheels such that the main body follows the suction unit based on the rotation of the first driving wheel and the rotation of the second driving wheel that are sensed by the wheel sensor.

12. The autonomous mobile cleaner of claim 11, wherein the obstacle avoidance pattern includes a first obstacle avoidance pattern.

13. The autonomous mobile cleaner of claim 12, wherein, in order to turn the main body to move in a direction opposite to the position of the front obstacle, according to the first obstacle avoidance pattern, the controller drives only one of the first driving wheel and the second driving wheel that is closer to the front obstacle sensed by the bumper sensor, drives the first and second driving wheels such that the one driving wheel has a greater rotation amount than the other driving wheel, or drives the first and second driving wheels in opposite directions.

14. The autonomous mobile cleaner of claim 13, wherein, the obstacle avoidance pattern further includes a second obstacle avoidance pattern, and the controller drives the first driving wheel and the second driving wheel by a predetermined rotation amount in the same rotation direction according to the second obstacle avoidance pattern before or after the first obstacle avoidance pattern.

15. A control method of an autonomous mobile cleaner including a main body, a suction unit provided separately from the main body, the suction unit configured to suck up surrounding foreign material, an air pipe configured to connect the main body and the suction unit and guide the foreign material into the main body, a first driving wheel installed at a first side of the main body and a second driving wheel installed at a second side of the main body, the second side being opposite the first side, a driving unit configured to drive the first and second driving wheels such that the main body follows the suction unit, and a wheel sensor connected to the first driving wheel and the second driving wheel, the control method comprising:

sensing rotation of the first driving wheel and the second driving wheel;

calculating a difference between the rotation amount of the first driving wheel and the rotation amount of the second driving wheel which are sensed by the wheel sensor; and controlling movement of the main body through the driving unit based on the difference between the rotation amount of the first driving wheel and the rotation amount of the second driving wheel.

16. The control method of claim 15, further comprising stopping driving the driving wheels before the sensing of the rotation of the driving wheels is performed.

17. The control method of claim 15, wherein, the sensing of the rotation of the driving wheels comprises sensing rotation of the first driving wheel and the second driving wheel, and the controlling movement of the main body comprises individually driving the first driving wheel and the second driving wheel in the same direction as the sensed rotation directions of the first driving wheel and the second driving wheel.

* * * * *